United States Patent [19]

Tibussek

[11] Patent Number: 4,637,659

[45] Date of Patent: Jan. 20, 1987

[54] TOOL MEMBER FOR A ROTARY DRILLING TOOL

[75] Inventor: Fritz Tibussek, Mönchengladbach, Fed. Rep. of Germany

[73] Assignee: Wirth Maschinen- und Bohrgerate-Fabrik GmbH, Erkelenz, Fed. Rep. of Germany

[21] Appl. No.: 661,305

[22] Filed: Oct. 16, 1984

[30] Foreign Application Priority Data

Oct. 19, 1983 [DE] Fed. Rep. of Germany ..... 3337931

[51] Int. Cl.[4] ..... E21B 10/16

[52] U.S. Cl. ..... 299/89; 299/90; 175/378

[58] Field of Search ..... 299/89, 90; 175/377, 175/378, 373, 374, 336, 341, 331, 334

[56] References Cited

U.S. PATENT DOCUMENTS

| | | | |
|---|---|---|---|
| 1,656,022 | 1/1928 | Scott | 175/378 |
| 2,041,146 | 5/1936 | Green | 175/313 |
| 2,177,332 | 10/1939 | Reed | 175/376 |
| 2,230,569 | 2/1941 | Howard et al. | 175/377 |
| 2,363,202 | 11/1944 | Scott | 175/378 |
| 2,380,112 | 7/1945 | Kinnear | 175/336 |
| 2,804,282 | 8/1957 | Spengler, Jr. | 175/378 |
| 2,907,551 | 10/1959 | Peter | 175/375 |
| 3,358,782 | 12/1967 | Bechem | 299/90 |
| 4,068,688 | 1/1978 | Benson | 299/89 |

FOREIGN PATENT DOCUMENTS

| | | |
|---|---|---|
| 1130389 | 5/1962 | Fed. Rep. of Germany . |
| 203898 | 2/1972 | Fed. Rep. of Germany . |
| 2210023 | 9/1972 | Fed. Rep. of Germany . |
| 1224748 | 6/1960 | France . |

*Primary Examiner*—Stephen J. Novosad
*Assistant Examiner*—Thuy M. Bui
*Attorney, Agent, or Firm*—Holman & Stern

[57] ABSTRACT

A toothed tool body for a rotary drilling tool suitable not only for work normally performed with toothed roller bits or the like, but also advantageous in loamy or similar formations, has ribs extending peripherally between the teeth up to the tooth flanks and having a cross-section falling on both sides from a peak region, more particularly a roof-like cross-section. The peak region of the ribs is lower than the tips or edges of the teeth in the radial direction of the tool body.

5 Claims, 2 Drawing Figures

TOOL MEMBER FOR A ROTARY DRILLING TOOL

FIELD OF THE INVENTION

The invention relates to a tool member for a rotatable drilling tool, such as a cutting roller or rotary drill bit, with spaced-apart teeth disposed in at least one annular peripheral region of a tool body, particularly with the teeth tips extending substantially axially or parallel to generatrices of the tool body.

PRIOR ART

A known roller drill (U.S. Pat. No. 2,165,584) has disc-shaped rotary tool members having a toothed peripheral region. A tooth having a peripherally extending edge (transverse tooth) is disposed between groups of teeth (longitudinal teeth) having edges extending substantially axially or parallel to the generatrices of the tool member. All the teeth are separate, i.e. the transverse teeth are separated from the longitudinal teeth by a space and the longitudinal teeth are separated by their bases. The edges of all the teeth have the same height, irrespective of their direction, and therefore project radially by the same amount.

There is also a known rotary drilling tool (U.S. Pat. No. 2,804,282) having a tool member with relatively wide-spaced longitudinal teeth in a peripheral region. The teeth have an edge at the tip and side edges for working on the wall of the bore. Transverse auxiliary teeth are disposed in the spaces between the main teeth and at a distance therefrom and are lower than the main teeth and are also used for working on the wall of the bore, particularly when the edges at the ends of the main teeth become worn and rounded.

The purpose of the previously-mentioned tools is to use variously-shaped and disposed tools simultaneously in drilling. The invention, however, is concerned with a fundamentally different problem. If a conventional cutting toller having teeth in annular peripheral regions comes across loam, clay, or similar material during drilling, the material tends to stick to the roller and foul it. The result may even be that the roller clogs completely in a short time and forms a loam ball and has to be taken out of service.

SUMMARY OF THE INVENTION

The object of the invention, therefore, is to devise a tool member for a rotary drilling tool of the initially mentioned kind which is advantageously used not only for drilling operations hitherto performed with toothed-roller bits or the like, but also greatly reduces or as far as possible eliminates the risk of clogging when working in loamy, clayey, or similar soil.

According to the invention, in the case of a tool member of the initially-mentioned kind, peripheral ribs extending to the tooth flanks are provided in the spaces between the teeth and have a cross-section descending on both sides from a peak region, the peak region being lower than the teeth tips in the radial direction of the tool member.

A tool member of the aforementioned kind or a drilling tool equipped therewith has a variety of uses. It is not only suitable for normal drilling operations performed with a toothed tooth, but also has the great advantage of being useful for drilling in loamy or similar formations or sticky material, even when solid formations and sticky formations occur successively or alternately during drilling. To this end, the ribs between the teeth continuously discharge the material, so that it cannot cake between the teeth.

In a very advantageous embodiment, the ribs at least in some cases have a substantially roof-like cross-section. Alternatively and advantageously, the ribs at least in some cases have a rounded cross-section. This applies both to the tip and the flank region of the ribs.

The tool body may more particularly be constructed so that a peripheral zone free from projections or teeth is left at least on one side of a toothed peripheral region, more particularly between two such peripheral regions. In the case of an insert in loamy or similar formations, the free peripheral area is advantageously associated with a stripper or the like held fixed relative to the tool member. A stripper may more particularly be secured to a holder bearing the tool.

The tool member can be constructed and manufactured in a variety of ways. It can be made up of individual parts, e.g. disc-shaped elements, or can be cast in one or more places or produced by drop forging—to mention only a few basic shapes and methods of manufacture. The teeth and/or ribs can be in one piece with the tool member or part thereof or can be secured as separate elements in a base member by insertion, welding, pressing, or other suitable means.

Other details, features and advantages of the invention will be clear from the claims and from the following description of a preferred embodiment with reference to the accompanying drawings.

DETAILED DESCRIPTION OF PREFERRED EMBODIMENT

Figure 1:
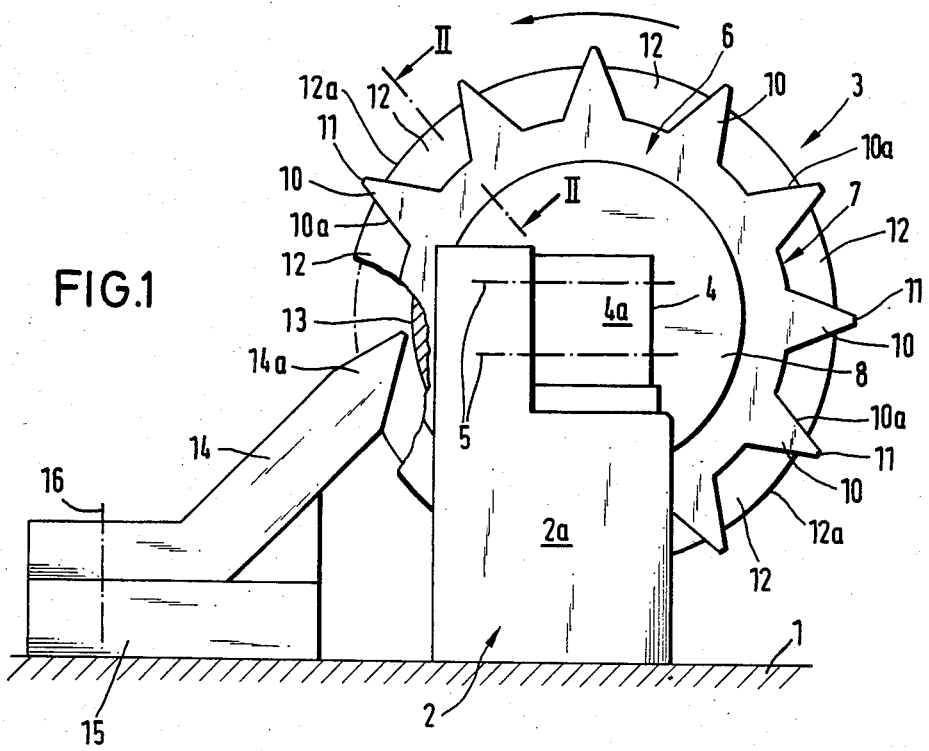
FIG. 1 shows a roller drilling tool with a tool member in side view, partly cut-away.

A bearing member 1, which can be part of a drilling head or large burr or similar unit, carries an e.g. U-shaped holder 2 for a rotary drilling tool 3 in the form of a cutting roller, holder 2 being secured to member 1. The limbs 2*a* of holder 2 receive the ends 4*a* of a fixed shaft 4 which is secured to holder 2 by screws (shown by their centre-lines 5 only in FIG. 1) and on which a tool member 6 is rotatably mounted in a known manner (not shown). The direction of rotation during work is shown by an arrow in FIG. 1.

In the present embodiment, the tool member 6 is produced e.g. in one piece by casting and comprises a frusto-conical body or base member 7 having a central bore or similarly-shaped cavity for receiving the bearing. Covers 8 (FIG. 1) of the like can be provided at the ends. Three annular peripheral regions 9 of member 7 have spaced-apart teeth 10. The edges 11 of the teeth tips are aligned substantially parallel to the generatrices of member 7. Ribs 12 in the spaces between teeth 10 extend peripherally up to the teeth flanks 10*a*. Ribs 12 have a cross-section descending on both sides from a peak region 12*a* and in the illustrated embodiment have a substantially roof-shaped or triangular cross-section as shown more particularly by the part in section in FIG. 2.

The peak region 12*a* of each rib 12 or its most projecting part is lower in the radial direction of member 6 than the tips or edges 11 of teeth 10.

In the illustrated embodiment, teeth 10 and ribs 12 are integral with member 7. Alternatively they may be inserted in a base member.

In the longitudinal direction of tool 6, peripheral zones 13 free from raised portions (FIG. 2), i.e. flat parts of member 7 in the present case, lie between the peripheral portions 9 comprising teeth 10 and ribs 12. Zones 13 can be associated with strippers 14, which are secured to a base plate 15 connected to holder 2 and/or member 1, e.g. via screws schematically indicated at 16.

Figure 2:
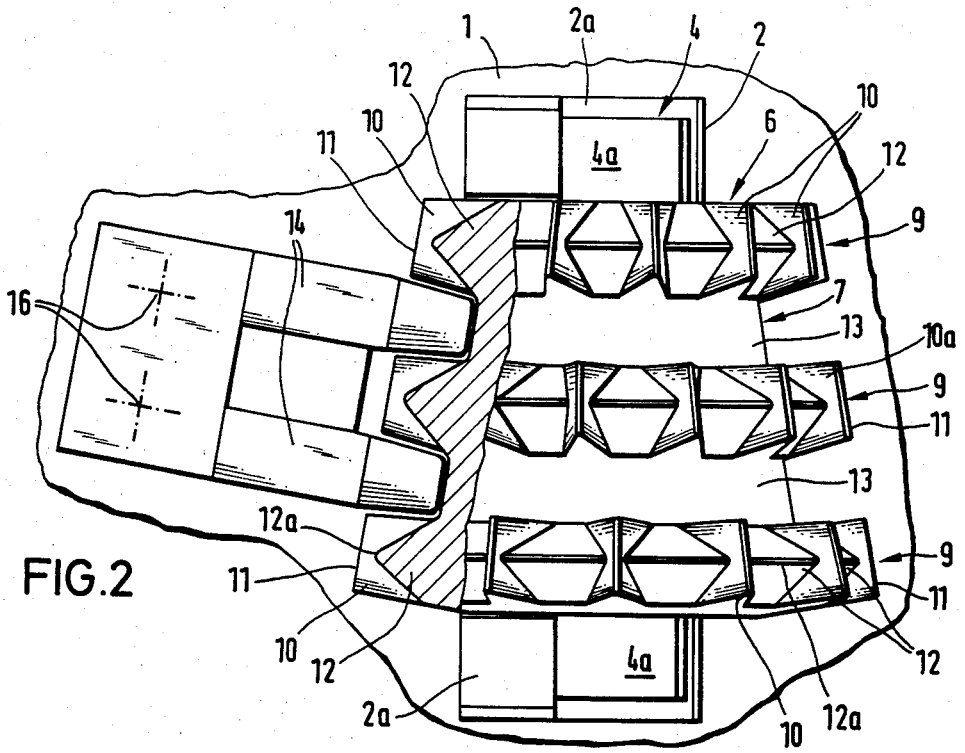
FIG. 2 is a plan view of the tool of FIG. 1, partly in section along line II—II in FIG. 1.

In the illustrated embodiment the strippers 14 have the shape of fingers whose tapering ends 14*a* extend to near the surface of zones 13, as shown in FIGS. 1 and 2. They can continuously free member 6 from drilled material, e.g. loam, driven to the side by ribs 12. Differently-shaped strippers can also be provided at the ends of the tool body.

The invention is not restricted to a cutting roller of the kind illustrated and described, but may advantageously be applied in principle to all rotary drilling tools, either for drilling devices or thrust and tunnel drilling machines or other applications.

All the features mentioned in the preceding description or shown in the drawings are to be considered as included in the invention either alone or in combinations, insofar as permitted by the prior art.

I claim:

1. A rotary tool member for a drilling tool, comprising:

a body having an axis of rotation, spaced-apart teeth disposed in at least one annular peripheral region of said body, each of said teeth having flanks and a tip, and peripheral ribs extending to said flanks in regions between said teeth, said ribs each having a cross-section descending on each rib on side from a peak rib region having a lower height than a height of said tip in a radial direction from said axis of said body.

2. The tool member of claim 1, in which at least some of said ribs have a substantially roof-like cross-section.

3. The tool member of claim 1, in which at least some of said ribs have a rounded cross-section.

4. The tool member of claim 1, in which each said tip extends substantially parallel to generatrices of said body.

5. The tool member of claim 1, having a free peripheral zone which is free from raised portions on at least one side of a peripheral tooth region, said free peripheral zone being associated with at least one stripper member which is held stationary relative to said body.

* * * * *